US006345438B1

(12) United States Patent
Zahnen et al.

(10) Patent No.: US 6,345,438 B1
(45) Date of Patent: Feb. 12, 2002

(54) METHOD FOR MAKING BUS AND POST ELECTRICAL CONNECTOR USING LOCKING PINS

(75) Inventors: James L. Zahnen; Edward Hielscher, both of Ormond Beach; Matthew D. Cawood, Deleone Springs, all of FL (US)

(73) Assignee: Homac Manufacturing Company, Ormond Beach, FL (US)

( * ) Notice: Subject to any disclaimer, the term of this patent is extended or adjusted under 35 U.S.C. 154(b) by 0 days.

(21) Appl. No.: 09/590,715

(22) Filed: Jun. 8, 2000

(51) Int. Cl.[7] ..... H01R 43/20

(52) U.S. Cl. ..... 29/876; 29/874; 29/882; 72/328

(58) Field of Search ..... 29/522.1, 882, 29/798, 796, 795, 797, 876, 874; 72/328

(56) References Cited

U.S. PATENT DOCUMENTS

| | | | | | |
|---|---|---|---|---|---|
| 1,900,099 | A | * | 3/1933 | Ferguson | 29/522.1 |
| 3,579,809 | A | * | 5/1971 | Wolf et al. | 29/522.1 |
| 4,232,812 | A | * | 11/1980 | Shibata | 29/882 |
| 4,805,280 | A | * | 2/1989 | Elander et al. | 29/882 |
| 4,831,711 | A | * | 5/1989 | Rapp et al. | 29/522.1 |
| 5,121,537 | A | * | 6/1992 | Matsui et al. | |
| 5,423,120 | A | * | 6/1995 | Kaneko | 29/882 |
| 5,555,620 | A | | 9/1996 | Kies | 29/874 |
| 5,608,965 | A | | 3/1997 | Kies | 29/874 |
| 5,611,142 | A | | 3/1997 | Kies | 29/874 |
| 5,690,516 | A | | 11/1997 | Fillinger | 439/798 |
| 5,766,044 | A | | 6/1998 | Norden | 439/798 |
| 5,884,386 | A | * | 3/1999 | Blacket et al. | 29/522.1 |
| 6,205,640 | B1 | * | 3/2001 | Dubugnon | 29/522.1 |

FOREIGN PATENT DOCUMENTS

| | | | | |
|---|---|---|---|---|
| JP | 40-10692 | * | 5/1965 | 29/522.1 |

OTHER PUBLICATIONS

Catalog—"Quality Electrical Connectors and Accessories", The Homac Companies–Industries Division, pp. 30–33.

* cited by examiner

*Primary Examiner*—Carl J. Arbes
(74) *Attorney, Agent, or Firm*—Allen, Dyer, Doppelt, Milbrath & Gilchrist, P.A.

(57) ABSTRACT

A method for making an electrical connector of the bus and post type includes connecting the posts to the bus with respective locking pins so that the posts extend outwardly from the bus. Each locking pin engages a lower open end of a post and extends into and engages a respective opening in the bus. Each locking pin may be expanded radially outwardly to securely engage adjacent portions of the bus and post. Accordingly, strong mechanical and electrical connection is established between the bus and the posts. Expanding each locking pin outwardly may be achieved by impacting at least one end face of each locking pin. In some embodiments, each post further has an upper open end in communication with the open lower end to define a central bore. Thus, expanding each locking pin outwardly may include positioning a first forming tool into the bore to contact a first end face of the locking pin, and while positioning a second forming tool on an opposite side of the bus to contact a second end face opposite the first end face.

31 Claims, 4 Drawing Sheets

METHOD FOR MAKING BUS AND POST ELECTRICAL CONNECTOR USING LOCKING PINS

FIELD OF THE INVENTION

The present invention relates to the field of electrical connectors, and, more particularly, to an electrical connector and associated manufacturing method.

BACKGROUND OF THE INVENTION

Underground and submersible junction bus connectors are widely used in electrical power distribution systems. One type of such connector is offered under the designation SWEETHEART® by Homac Mfg. Company of Ormond Beach, Fla., the assignee of the present invention. The SWEETHEART® connector is a cast or welded aluminum connector including a bus, or bar, portion and a series of tubular posts extending outwardly from the bus portion. The posts have an upper open end to receive one or more electrical conductors. A threaded bore is provided in the sidewall of the post, and which receives a fastener to secure the electrical conductor within the upper end of the post. An insulating coating is provided on the lower portion of the posts and bus of the connector. In addition, EPDM insulating sleeves may be used to provide waterproof seals for the posts.

Unfortunately, the casting method for making such a connector may result in small trapped bubbles which leave internal voids in the casting. The internal voids may reduce the strength of the connector. The surface texture of the cast parts may be relatively rough, thereby requiring additional grinding or finishing steps. In addition, different molds are typically required for the different connector sizes and configurations. Accordingly, casting may be relatively expensive. In addition, a cast part may have a lower electrical conductivity.

U.S. Pat. Nos. 5,766,044; 5,555,620 and 5,608,965 each discloses an alternate approach to casting of the bus and post connector. A hollow-end milling cutter is used to form the entire extent of the upstanding posts from generally rectangular extruded stock material, and while also leaving the bus or bar portion at the base of the connector. In other words, an integrally formed monolithic connector is produced without casting and starting from extruded aluminum stock.

While the hollow-end milling approach offers a number of potential advantages, there are also shortcomings. In particular, a relatively large amount of the starting aluminum stock material must be removed and is therefore wasted. Also, the cost of the aluminum stock may also be relatively high because the stock must have a height dimension that is at least as great as the bus portion plus the full height of the posts. Of course, the number of required machining steps may increase the cost of the electrical connector produced by such hollow-milling cutter techniques.

SUMMARY OF THE INVENTION

In view of the foregoing background, it is therefore an object of the present invention to provide a method for making a bus and post connector preferably without casting, and while reducing the waste and other drawbacks of the hollow-milling cutter based approaches of the prior art.

This and other objects, features and advantages in accordance with the present invention are provided by a method for making an electrical connector by engaging respective locking pins into respective lower open ends of the posts and extending outwardly and into corresponding openings in the bus to secure the posts and bus together with the posts extending outwardly from the bus. Engaging the locking posts to the bus may also comprise expanding each locking pin radially outwardly to securely engage adjacent portions of the bus and post. Accordingly, strong mechanical and electrical connection is established between the bus and the posts.

Expanding each locking pin outwardly may comprise impacting at least one end face of the locking pin. More particularly, in some embodiments, each post further has an upper open end in communication with the lower open end to define a bore extending through the post. Thus, expanding each locking pin outwardly may comprise positioning a first forming tool into the bore to contact a first end face of the locking pin, and while positioning a second forming tool on an opposite side of the bus to contact a second end face of the locking pin opposite the first end face.

At least one opening in the bus and the lower open end of a corresponding post may have a substantially similar cross-sectional shape. The cross-sectional shape may be generally circular and uniform, and, therefore, a corresponding locking pin may have a cylindrical shape.

In other embodiments, at least one opening in the bus may have a generally circular cross-sectional shape and the open lower end of a corresponding post may have a tapered circular cross-sectional shape. For these embodiments, the corresponding locking pin has a cylindrical lower portion for the opening in the bus, and a frustoconical upper portion for the tapered open lower end of the corresponding post. This taper angle may in a range of about 1–5 degrees, for example.

The posts may also have different configurations. For example, at least one post may further have an upper open end in communication with the open lower end to define a bore through the post for receiving at least one electrical conductor. In addition, such a post may have at least one threaded passageway extending transversely into the bore. In addition, the post may have an increased thickness wall portion through which the at least one threaded passageway extends. This provides greater holding strength for the associated fastener. In other embodiments, one or more of the posts may have a closed upper end and an uppermost tab with at least one opening therein for receiving a fastener to secure an electrical conductor thereto.

The method may also include forming an insulating coating on at least the bus and lower portions of the posts. The bus may have a generally rectangular shape. In addition, at least one or all of the bus, posts and locking pins preferably comprises a metal, such as aluminum, for example. Extruded aluminum may be particularly advantageous and avoids some of the drawbacks of cast aluminum, for example. In some embodiments, the electrical connector may include posts having different configurations or sizes, as to accommodate different sized conductors.

Another aspect of the invention relates to the electrical connector, such as formed by the above described method. More particularly, the electrical connector may include a bus having a plurality of openings therein; a plurality of posts for connecting to electrical conductors, each post having a lower open end; and a plurality of locking pins, each locking pin extending from within a respective lower open end of a post into a corresponding opening in the bus to connect the posts and bus together so that the posts extend outwardly from the bus. At least one opening in the bus and the lower open end of a corresponding post may have a substantially similar cross-sectional shape. This cross-sectional shape may be generally circular and uniform, and the corresponding locking pin will also have a cylindrical shape.

At least one opening in the bus may also have a generally circular cross-sectional shape, and the lower open end of a corresponding post may have a tapered circular cross-sectional shape. For these embodiments, the corresponding locking pin preferably has a cylindrical lower portion for the opening in the bus and a frustoconical upper portion for the lower open end of the corresponding post. The frustoconical upper portion may have a taper angle in a range of about 1–5 degrees.

The upper end of one or more of the posts may be open and in communication with the open lower end to receive an electrical conductor. Alternately, the upper end of the post may have a tab with an opening therein to receive a fastener for securing an electrical conductor to the post.

DETAILED DESCRIPTION OF THE PREFERRED EMBODIMENTS

The present invention will now be described more fully hereinafter with reference to the accompanying drawings in which preferred embodiments of the invention are shown. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout. Prime notation is used in alternate embodiments to indicate similar elements.

Referring initially to FIGS. 1–7, an electrical connector 20 and method for making the connector are first described. The electrical connector 20 is of a type that includes a bus or bus portion 27 and a plurality of towers or posts 30*a*–30*d* extending outwardly therefrom, and wherein each post can receive one or more electrical conductors.

A method aspect of the invention is for making the electrical connector 20. The method preferably comprises providing a bus 27 having first and second opposing surfaces 27*a*, 27*b*, respectively, and openings 28*a*–28*d* extending through the bus from the first to second surfaces. Those of skill in the art will appreciate that in other embodiments the openings 28*a*–28*d* need not extend completely through the bus.

The method also includes providing a plurality of posts 30*a*–30*d*, each having a lower open end which will be secured to the bus 27. During assembly, each post 30*a*–30*d* preferably has its lower open end positioned adjacent the first surface 27*a* of the bus 27, and a locking pin 32*a*–32*d* is positioned to be engaged in the lower open end of the posts 30*a*–30*d* and extending into the openings 28*a*–28*d* in the bus 27 to secure each post to the bus.

Figure 5:
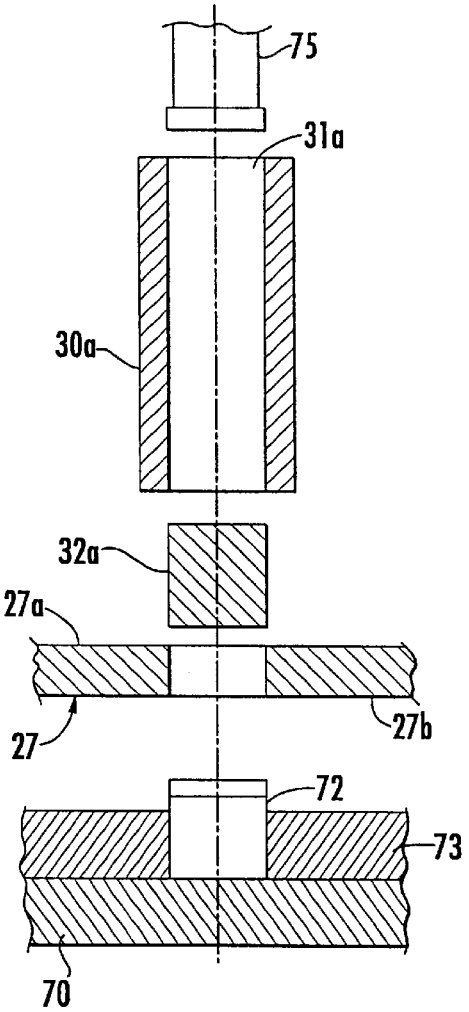
FIGS. 5 and 6 are schematic cross-sectional views of a portion of the bus and a post of the electrical connector being assembled together in accordance with the invention.
Figure 6:
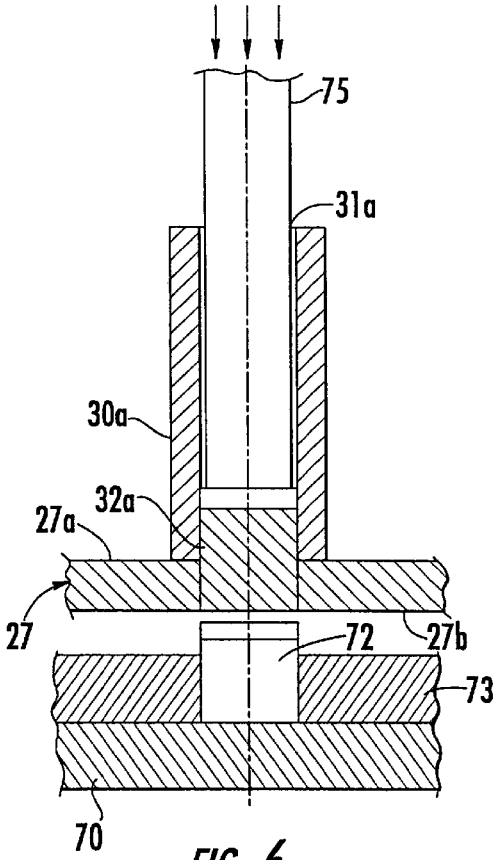
Figure 7:
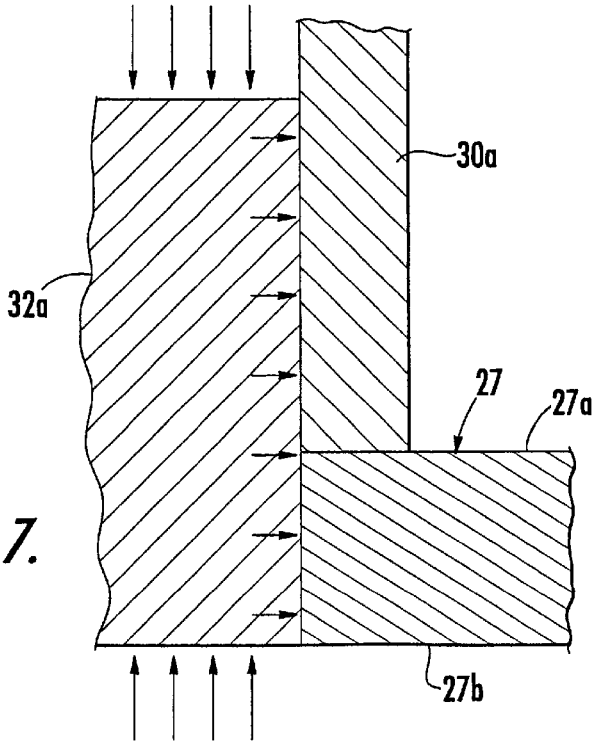
FIG. 7 is an enlarged schematic cross-sectional view of a portion of FIG. 6.

The positioning of the locking pins 32*a*–32*d* may be accomplished as shown with particular reference to FIGS. 5–7. A punch holder plate 70 illustratively supports or mounts a first forming tool 72. A stripper plate 73 is illustratively provided on the punch holder plate 70.

A second forming tool 75 is illustratively moved downwardly into contact with the upper surface of the locking pin 32*a*, while the lower forming tool 72 illustratively contacts the lower surface of the pin (FIG. 6) to cause the pin to expand radially outwardly (FIG. 7) to tightly engage adjacent portions of the bus 27 and the post 30*a*.

The locking pin 32*a* securely attaches the post 30*a* to the bus 27. As shown in the illustrated embodiment, the forming tools 72, 75 cooperate to urge the material of the locking pin 32*a* radially outwardly to more tightly engage adjacent portions of the post 30*a* as perhaps best understood with reference to FIG. 7. The method simplifies manufacturing of the connector 20, reduces waste compared to hollow-milling manufactured connectors, and may also overcome the disadvantages of a cast connector. In addition, this fabrication method provides advantages in terms of tolerances for the various machining operations. Considered in other terms, the method is relatively forgiving of normal wear and tear on the tooling, yet provides a strong and reliable connection of the posts 30*a*–30*d* to the bus 27.

Although the locking pin 32*a* is illustratively in the form of a solid circular cylinder, it may have other cross-sectional shapes as well. The locking pin may have a tubular shape with a central passageway, and/or may have projections or ridges on its outer surface as will be appreciated by those skilled in the art. The locking pin 32*a* desirably is formed of an electrically conductive material, such as metal, and more preferably aluminum, for example, that can be shaped or otherwise radially expanded to ensure a strong mechanical and electrical connection with adjacent portions of the post 30*a* and bus 27.

In other embodiments, it may not be necessary to provide the first forming tool 72 to contact the lower end of the locking pin 32*a*. Instead the opening could be a blind opening, for example, extending from the first or upper surface 27*a* without extending through to the lower surface 27*b*. In addition, in other embodiments, the post 30*a* could have a closed upper end and the upper forming tool 75 would then not be needed. One such alternate post will described later herein. Use of one or both of the forming tools 72, 75 does provide for greater tolerances as may be caused by tooling wear, for example, as will be appreciated by those skilled in the art.

The bus 27 and the posts 30*a*–30*d* preferably comprise metal, such as aluminum or extruded aluminum stock, for example. Such a material is electrically conducting and readily shapable to produce the locking pin connection as will be appreciated by those skilled in the art. Of course, other metals and materials are also contemplated for the components of the connector 20 as will also be appreciated by those skilled in the art.

The number, size and spacing of the locking pins 32*a*–32*d* is dependent on the particular connector design desired. In the illustrated connector 20 four pins are illustrated with the rightmost pin 32*d* having a larger diameter to accommodate a larger post 30*d* which, in turn, can accommodate a larger electrical conductor.

Figure 8:
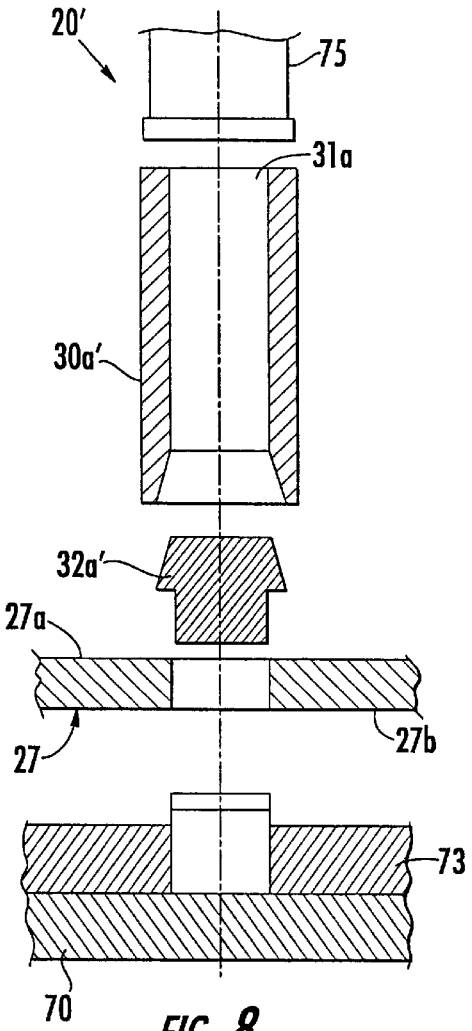
FIGS. 8 and 9 are schematic cross-sectional views of a portion of the bus and a post of an alternate embodiment of the electrical connector being assembled together in accordance with the invention.
Figure 9:
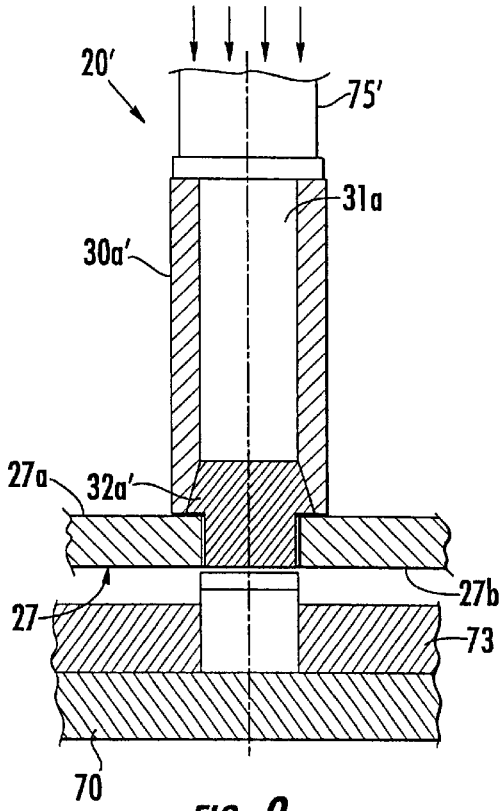

Referring now additionally to FIGS. 8 and 9, another variation of the connector 20' is described wherein a slight taper angle is provided in the lower open end of the posts, such as the illustrated post 30*a*'. For example, the taper angle may be in a range of about 1–5 degrees, although other angles are also contemplated by the invention. In this embodiment, the locking pin 32*a*' includes an upper tapered portion and a cylindrical lower portion as illustrated. The taper angle may provide a more snug engagement between the post 30*a*' and the pin 32*a*'.

The tapered portion of the locking pin 32*a*' also defines a peripheral ledge which seats against the adjacent upper surface portions of the bus 27 as shown in FIG. 9 when the connector 20' is assembled. The assembly of the connector 20' with the tapered locking pins 30*a*' is basically the same as mentioned above for the cylindrical or straight sidewall embodiments, and like elements are indicated with the same reference numerals. One difference is that the upper forming tool 75' contacts the upper end of the post 30*a*', rather than extending into the opening 31*a* of the post. Accordingly, these like elements need no further discussion herein.

In other embodiments, the locking pin could have a reverse configuration with the taper defined in the lower portion and the cylindrical shape defined by the upper portion. In yet other embodiments, both portions of the locking pin may have a tapered shape. It should be noted, however, that the cylindrical or straight sidewall configuration of the locking pins 32*a*–32*d* as shown in FIGS. 1–7 may also provide a secure connection, and while avoiding the need for the taper-forming machining steps as will be appreciated by those skilled in the art.

Figure 1:
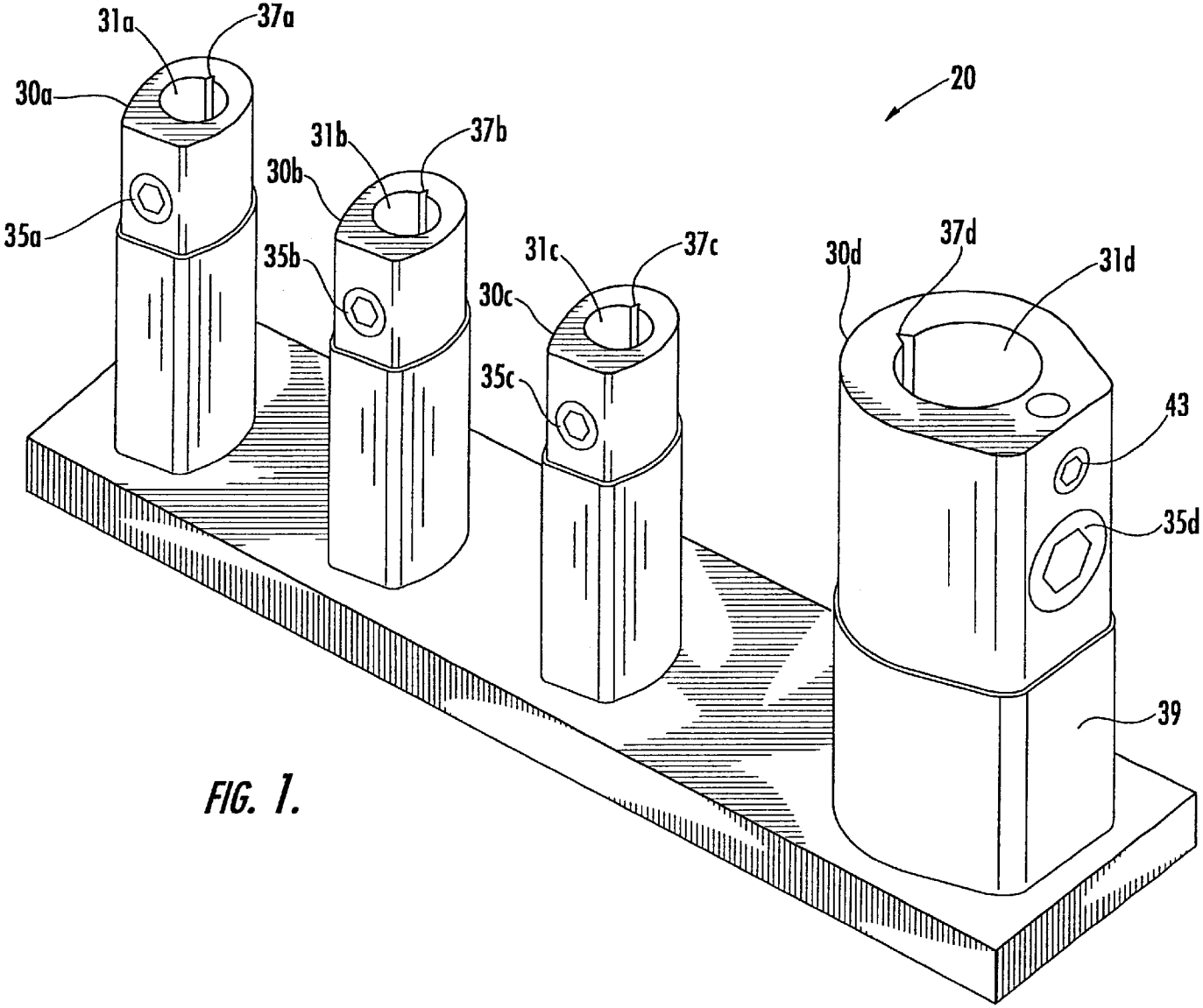
FIG. 1 is a perspective view of an electrical connector in accordance with the present invention.

Returning again to the connector 20 shown in FIG. 1, the bus 27 may have a generally rectangular shape, such as in the shape of a bar, as shown in the illustrated embodiment. As mentioned above, each post 30*a*–30*d* may be provided with a bore 31*a*–31*d* extending therethrough which defines the lower open end and also an upper open end for receiving at least one electrical conductor therein. Each post 30*a*–30*d* may also include at least one threaded passageway 34*a*–34*d* (FIG. 2) therein and extending transversely into the bore. Each of the threaded passageways 34*a*–34*d* preferably receives a respective fastener 35*a*–35*d* (FIGS. 1 and 3) to secure the conductor in the post. For example, the fasteners may be a ball-ended screws each having a hexagonal recess therein as illustrated in FIG. 1.

Each post may also be provided with an increased thickness wall portion through which the threaded passageway 34*a*–34*d* extends to strengthen that portion of the post. The increased thickness wall portion permits a more efficient use of material, wherein strength and a larger wall thickness to receive a fastener are provided where needed in the illustrated embodiment. In other embodiments, the wall thickness may be uniform as will be appreciated by those skilled in the art.

Figure 2:
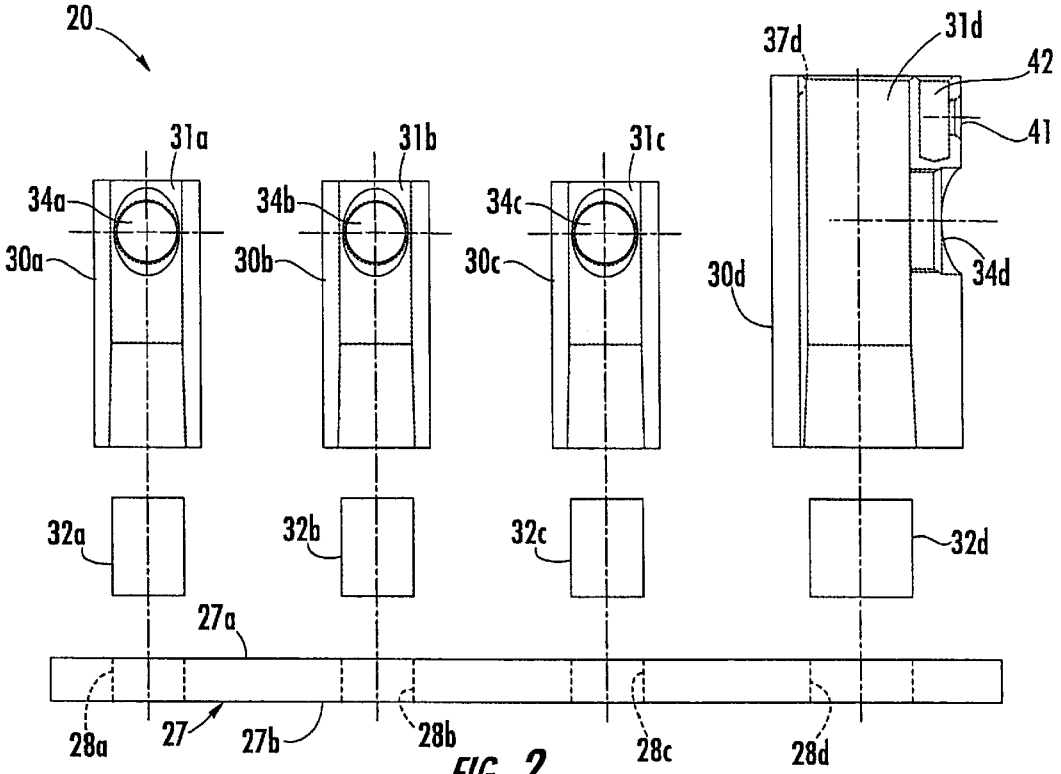
FIG. 2 is a side elevational view of the components of the electrical connector as shown in FIG. 1 prior to assembly of the bus and posts together.
Figure 3:
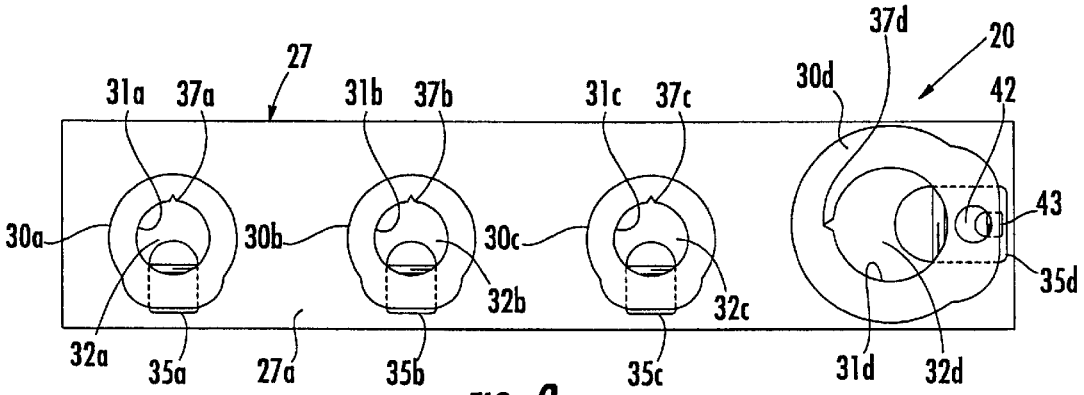
FIG. 3 is a top plan view of the electrical connector after assembly of the bus and posts together in accordance with the invention.
Figure 4:
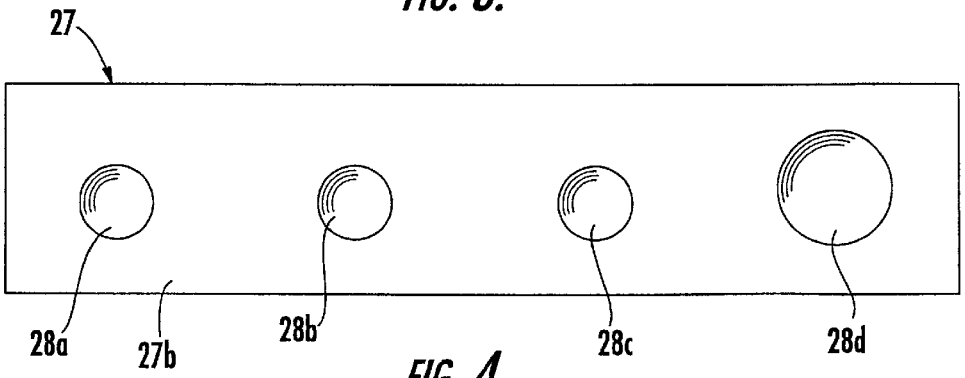
FIG. 4 is a bottom view of the connector as shown in FIG. 3.

As seen in FIGS. 1, 2 and 3, the largest post 30*d* in the illustrated connector 20 also includes a second bore 42, extending in the sidewall parallel to the main bore 31*d*, for receiving a smaller conductor. In addition, a second threaded passageway 41 (FIG. 2) is provided in communication with the second bore 42 to receive an associated screw or fastener 43 (FIGS. 1 and 3). Each of the posts 30*a*–30*d* also includes a vertical groove or recess 37*a*–37*d* which permits receiving a smaller gauge wire or conductor also in the main bore as will be appreciated by those skilled in the art. The illustrated metal posts 30*a*–30*d* include three identical posts 30*a*–30*c* and one larger post 30*d*. In other embodiments, all of the posts may be identical, for example, as will also be appreciated by those skilled in the art.

Figure 10:
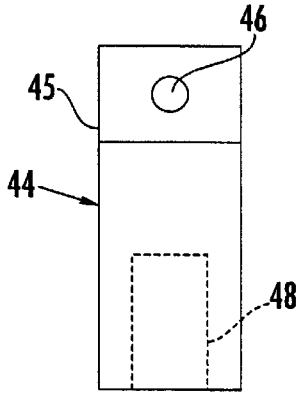
FIG. 10 is a front elevational view of an alternate embodiment of a post for use in the connector in accordance with the present invention.
Figure 11:
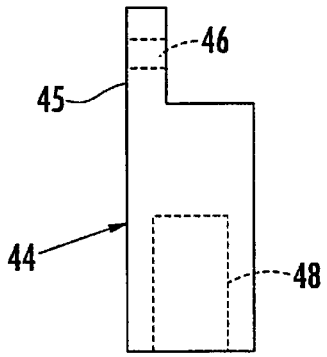
FIG. 11 is a side elevational view of the post as shown in FIG. 10.

The connector 20 may also include many different types of posts. The posts 30*a*–30*d* in the embodiment of the connector 20 as shown in FIGS. 1–7 are already described herein. A tapered post 30*a* is shown in FIGS. 8 and 9 and also described above. Turning now also to FIGS. 10 and 11, a different type of post 44 may also be used in accordance with another advantageous feature of the invention. The post 44 may comprise an uppermost tab 45 with at least one opening 46 therein for receiving a fastener to secure an electrical conductor thereto. Of course, the post 44 also includes a lower open end 48 for securing to the bus 27 as will be appreciated by those of skill in the art. The post 44 could also have a tapered lower open end. The illustrated type of post 44 can be used exclusively or mixed and matched with the posts 30*a*–30*d* described above.

The method for making the connector 27 may also include forming an insulating coating 39 (FIG. 1) on at least the bus 27 and lower portions of the posts 30*a*–30*d*. The posts 30*a*–30*d* may have different configurations, in terms or size and/or shape, than other posts as shown in the illustrated embodiments.

A significant advantage of the present invention over the prior art is that the stock material waste is greatly reduced as compared to using hollow-milling cutting approaches. In addition, the invention may also offer the advantages of using extruded or other material versus cast material. Lastly, the present invention provides for less exacting tolerances in the components of the connector 20, but perhaps more importantly, in the tooling used to make and assemble the components as will be appreciated by those skilled in the art.

Many modifications and other embodiments of the invention will come to the mind of one skilled in the art having the benefit of the teachings presented in the foregoing descriptions and the associated drawings. Accordingly, it is understood that the invention is not to be limited to the illustrated embodiments disclosed, and that the modifications and embodiments are intended to be included within the spirit and scope of the appended claims.

That which is claimed is:

1. A method for making an electrical connector comprising a bus and a plurality of posts extending outwardly therefrom, the method comprising:

providing a bus having a plurality of openings therein;

providing a plurality of posts, each post having a lower open end;

providing a plurality of locking pins; and engaging the locking pins into respective lower open ends of the posts and extending outwardly and into corresponding openings in the bus to secure the posts and bus together with the posts extending outwardly from the bus.

2. A method according to claim 1 wherein engaging the locking pins further comprises expanding each locking pin radially outwardly to securely engage adjacent portions of the bus and post.

3. A method according to claim 2 wherein expanding comprises impacting at least one end face of each locking pin.

4. A method according to claim 3 wherein each post has a bore extending therethrough; and further comprising positioning a forming tool into the bore to impact a first end face of the locking pin and while positioning a second forming tool to impact a second end face of the locking pin opposite the first end face.

5. A method according to claim 1 wherein at least one opening in the bus and the lower open end of a corresponding post have a substantially similar cross-sectional shape.

6. A method according to claim 5 wherein the cross-sectional shape is generally circular and uniform, and wherein a corresponding locking pin has a cylindrical shape.

7. A method according to claim 1 wherein at least one opening in the bus has a generally circular cross-sectional shape and the lower open end of a corresponding post has a tapered circular cross-sectional shape, and wherein a corresponding locking pin has a cylindrical lower portion for the opening in the bus and a frustoconical upper portion for the open lower end of the corresponding post.

8. A method according to claim 7 wherein the frustoconical upper portion has a taper angle in a range of about 1–5 degrees.

9. A method according to claim 1 wherein providing the posts comprises providing each post having a bore extending therethrough defining the lower open end and an upper open end for receiving at least one electrical conductor therein.

10. A method according to claim 9 wherein providing the posts comprises providing each post to have at least one threaded passageway therein and extending transversely into the bore.

11. A method according to claim 10 wherein providing the posts comprises providing each post to have an increased thickness wall portion through which the at least one threaded passageway extends.

12. A method according to claim 1 wherein providing the posts comprises providing each post to comprise an uppermost tab with at least one opening therein for receiving a fastener to secure an electrical conductor thereto.

13. A method according to claim 1 further comprising forming an insulating coating on at least the bus and lower portions of the posts.

14. A method according to claim 1 wherein the bus has a generally rectangular shape.

15. A method according to claim 1 wherein at least one of the bus, posts and locking pins comprises metal.

16. A method according to claim 1 wherein providing the posts comprises providing at least some of the posts with different configurations.

17. A method for making an electrical connector comprising a bus and a plurality of posts extending outwardly therefrom, the bus having a plurality of openings therein, and each post having a lower open end, the method comprising:

providing a plurality of locking pins; and positioning and expanding the locking pins into engagement with respective lower open ends of the posts and extending outwardly and into engagement with corresponding openings in the bus to secure the posts and bus together with the posts extending outwardly from the bus.

18. A method according to claim 17 wherein positioning and expanding comprises impacting at least one end face of each locking pin.

19. A method according to claim 18 wherein each post has a bore extending therethrough; and further comprising positioning a forming tool into the bore to impact a first end face of the locking pin and while positioning a second forming tool to impact a second end face of the locking pin opposite the first end face.

20. A method according to claim 17 wherein at least one opening in the bus and the lower open end of a corresponding post have a substantially similar cross-sectional shape.

21. A method according to claim 20 wherein the cross-sectional shape is generally circular and uniform, and wherein a corresponding locking pin has a cylindrical shape.

22. A method according to claim 17 wherein at least one opening in the bus has a generally circular cross-sectional shape and the lower open end of a corresponding post has a tapered circular cross-sectional shape, and wherein a corresponding locking pin has a cylindrical lower portion for the opening in the bus and a frustoconical upper portion for the open lower end of the corresponding post.

23. A method according to claim 22 wherein the frustoconical upper portion has a taper angle in a range of about 1–5 degrees.

24. A method according to claim 17 wherein each post has a bore extending therethrough defining the lower open end and an upper open end for receiving at least one electrical conductor therein.

25. A method according to claim 24 wherein each post has at least one threaded passageway therein and extending transversely into the bore.

26. A method according to claim 25 wherein each post has an increased thickness wall portion through which the at least one threaded passageway extends.

27. A method according to claim 17 wherein each post comprises an uppermost tab with at least one opening therein for receiving a fastener to secure an electrical conductor thereto.

28. A method according to claim 17 further comprising forming an insulating coating on at least the bus and lower portions of the posts.

29. A method according to claim 17 wherein the bus has a generally rectangular shape.

30. A method according to claim 17 wherein at least one of the bus, posts and locking pins comprises metal.

31. A method according to claim 17 wherein at least some of the posts have different configurations.

* * * * *